US005690082A

United States Patent [19]

Tanioka et al.

[11] Patent Number: 5,690,082

[45] Date of Patent: Nov. 25, 1997

[54] STRUCTURE FOR SUPPORTING EGR VALVE IN ENGINE

[75] Inventors: Masatoshi Tanioka; Koji Tsuchida, both of Wako, Japan

[73] Assignee: Honda Giken Kogyo Kabushiki Kaisha, Tokyo, Japan

[21] Appl. No.: 711,464

[22] Filed: Sep. 11, 1996

[30] Foreign Application Priority Data

Sep. 13, 1995 [JP] Japan ..... 7-234837

[51] Int. Cl.[6] ..... F02M 25/07; F01P 3/12; F01P 3/20

[52] U.S. Cl. ..... 123/570; 123/41.28; 123/41.29; 123/41.31

[58] Field of Search ..... 123/41.28, 41.29, 123/41.31, 570

[56] References Cited

U.S. PATENT DOCUMENTS

| | | | |
|---|---|---|---|
| 1,629,664 | 5/1927 | Jack | 123/41.28 |
| 2,713,332 | 7/1955 | Beardsley | 123/41.28 |
| 3,782,348 | 1/1974 | Linder | 123/570 |
| 3,937,196 | 2/1976 | Cook et al. | 123/570 |
| 4,163,282 | 7/1979 | Yamada et al. | 123/570 |
| 4,413,596 | 11/1983 | Hirayama | 123/41.29 |
| 4,953,525 | 9/1990 | Sakurai et al. | 123/41.28 |
| 5,490,488 | 2/1996 | Aversa et al. | 123/570 |

*Primary Examiner*—Willis R. Wolfe

*Attorney, Agent, or Firm*—Armstrong, Westerman, Hattori, McLeland & Naughton

[57] ABSTRACT

A water passage is provided separately from an intake manifold to interconnect water jackets provided in a front bank and a rear bank of a horizontal V-type engine. An EGR valve is supported on a valve mounting seat which is provided at a front portion of the water passage. A water passageway through which cooling water flows, and a gas passageway through which an EGR gas flows, are defined in the water passage in close proximity to one another. The EGR valve is cooled by cooling wind passed through a fan opening in a radiator and by cooling water flowing through the water passageway. Thus, it is possible to avoid thermal influence on the intake manifold by the EGR valve, and to cool the EGR valve without the need for special cooling means.

18 Claims, 7 Drawing Sheets

STRUCTURE FOR SUPPORTING EGR VALVE IN ENGINE

BACKGROUND OF THE INVENTION

1. Field of the Invention

The present invention relates to an engine equipped with an EGR system (an exhaust gas circulating system) and more particularly, to a structure for supporting an EGR valve on an engine.

2. Description of the Related Art

The EGR system for circulating exhaust gas removed from an exhaust passage into an intake passage to improve the emission includes an EGR valve for controlling the EGR amount in accordance with operational conditions of the engine. In the conventional EGR system, the EGR valve is mounted in an intake manifold (for example, see Japanese Patent Publication No. 61-58660).

However, if the EGR valve through which a high-temperature exhaust gas is passed is mounted in the intake manifold, the temperature of the intake air is raised as a result of the heat of the exhaust gas, resulting in a reduced intake efficiency. If the intake manifold is intended to be cooled by cooling water in order to avoid this problem, a cooling water passageway must be defined, resulting in a complicated structure for the manifold.

SUMMARY OF THE INVENTION

Accordingly, it is an object of the present invention to avoid the thermal influence exerted on the intake manifold by the EGR valve and to effectively cool the EGR valve without the need to provide special cooling means.

To achieve the above object, according to a first aspect and feature of the present invention, there is provided a structure for supporting an EGR valve in an engine, comprising a water passage provided separately from an intake manifold and connected to a water jacket provided in a cylinder head of the engine, the water passage being integrally formed with a valve mounting seat for supporting the EGR valve and a gas passageway connected to the EGR valve.

With such an arrangement, the EGR valve through which the high-temperature EGR gas passes can be effectively cooled by utilizing cooling water passing through the water passage without use of special cooling means. Moreover, there is no possibility that the temperature of the intake air is raised by the EGR gas to reduce the intake efficiency, because the water passage having the EGR valve supported therein is separate from the intake manifold.

According to a second aspect and feature of the invention, there is provided a structure for supporting an EGR valve in a horizontal V-type engine having a front bank and a rear bank, the structure comprising a water passage provided separately from an intake manifold to interconnect water jackets provided in the front and rear banks, and an EGR valve supported near a connection of the water passage to the front bank.

With the above arrangement, not only the EGR valve through which the high-temperature EGR gas passes can effectively be cooled utilizing cooling water passing through the water passage without the use of special cooling means, but also cooling air can effectively be applied to the EGR valve to enhance the cooling effect. Moreover, there is little tendency for the temperature of the intake air to be raised by the EGR gas to reduce the intake efficiency, because the water passage having the EGR valve supported therein is separate from the intake manifold.

The above and other objects, features and advantages of the invention will become apparent from the following description of the preferred embodiment taken in conjunction with the accompanying drawings.

DETAILED DESCRIPTION OF THE PREFERRED EMBODIMENT

Figure 1:
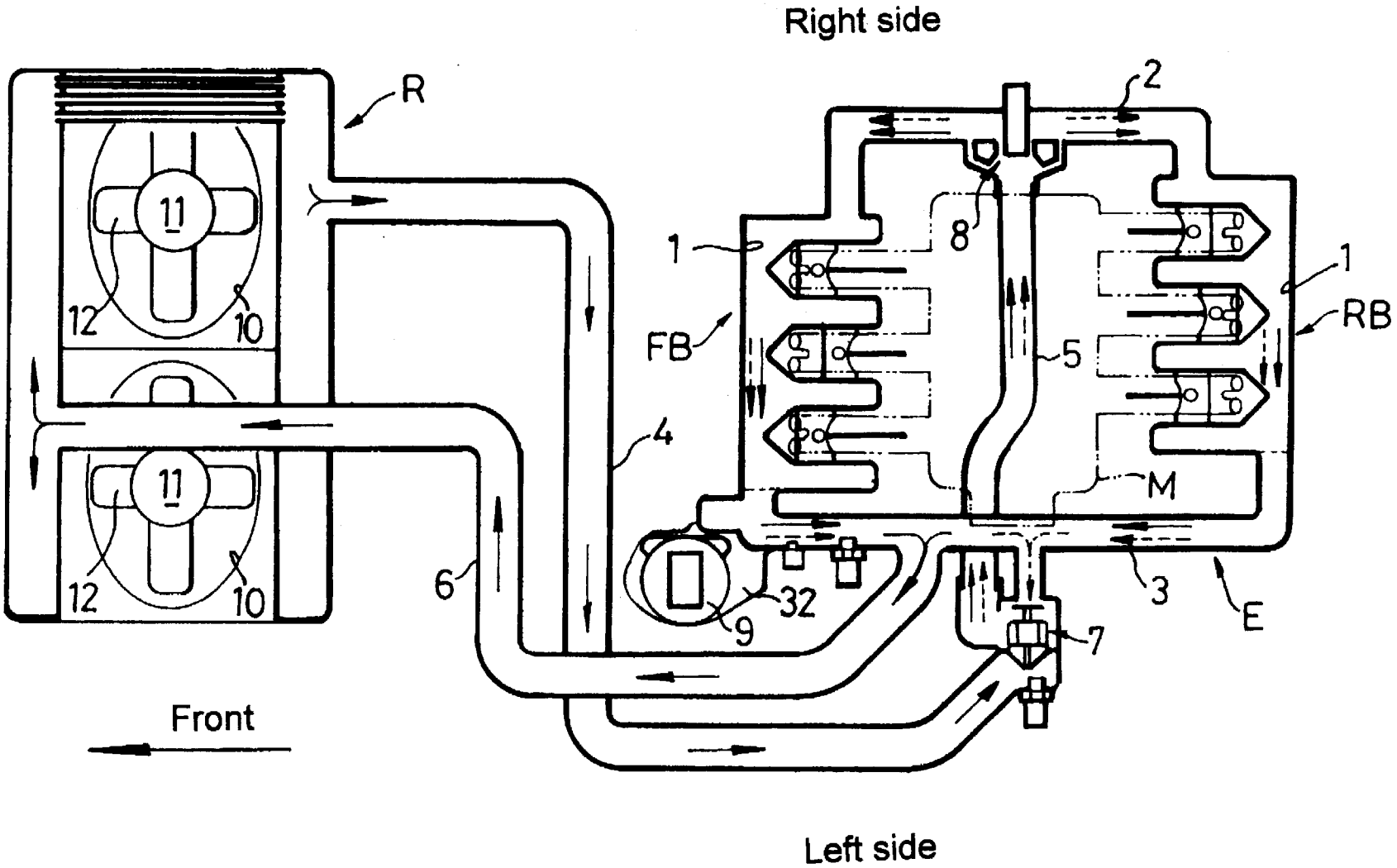
FIG. 1 is a see-through view showing a cooling-water system in a horizontal V-type engine equipped with a valve supporting structure according to an embodiment of the present invention.

FIG. 1 shows a V-type 6-cylinder engine E having a crankshaft disposed in a lateral direction of a vehicle body. The engine E includes a front bank FB located at a front portion of the vehicle body, and a rear bank RB located at a rear portion of the vehicle body. Water jackets 1, 1, through which water passes, are defined in the front and rear banks FB and RB, respectively. A first water passage 2 is provided in a right side of the engine E to permit the water jackets 1, 1 in the banks FB and RB to communicate with each other, and a second water passage 3 is provided in a left side of the engine E to permit the water jackets 1, 1 in the banks FB and RB to communicate with each other.

A first cooling-water pipe 4 extends from a radiator R toward the engine E and is connected to an intermediate portion of the second water passage 3, and a second cooling-water pipe 5 diverging from the first cooling-water pipe 4 is connected to an intermediate portion of the first water passage 2. A third cooling-water pipe 6 diverges from an intermediate portion of the second water passage 3 and extends toward the radiator R.

A thermo-valve 7 is mounted in a junction of the second water passage 3 and the first and second cooling-water pipes 4 and 5, and a cooling-water pump 8 is provided in a junction of the first water passage 2 and the second cooling-water pipe 5. Further, an EGR valve 9 is supported at a front portion of the second water passage 3 connected to the left side of the front bank FB.

A pair of left and right radiator fans 12, 12 are disposed within a pair of fan openings 10, 10 defined in the radiator R and are driven by motors 11, 11, respectively.

Thus, during normal operation of the engine E after warm-up, cooling water exiting the radiator R is circulated through the first cooling-water pipe 4, the thermo-valve 7, the second cooling-water pipe 5, the cooling-water pump 8, the first water passage 2, the water jackets 1, 1 in the banks FB and RB, the second water passage 3 and the third cooling-water pipe 6 by putting the first cooling-water pipe 4 and the second cooling-water pipe 6 into communication with each other and putting the first cooling-water pipe 4 and the second water passage 3 out of communication by means of the thermo-valve 7.

On the other hand, during warm-up of the engine E, the first and second cooling-water pipes 4 and 5 are put out of communication with each other, and the second cooling-water pipe 5 and the second water passage 3 are put into communication with each by means of the thermo-valve 7. The cooling water is circulated through a closed circuit which includes the thermo-valve 7, the second cooling-water pipe 5, the cooling-water pump 8, the first water passage 2, the water jackets 1, 1 in both the banks FB and RB, and the second water passage 3, as shown by a dashed line arrow in FIG. 1, so as to promote warming of the engine E.

Reference character M in FIG. 1 indicates an intake manifold disposed in a valley between both the banks FB and RB communicating with an intake port in each cylinder head. The intake manifold M is formed of a material different from that for the second water passage 3 which supports the EGR valve 9.

Figure 2:
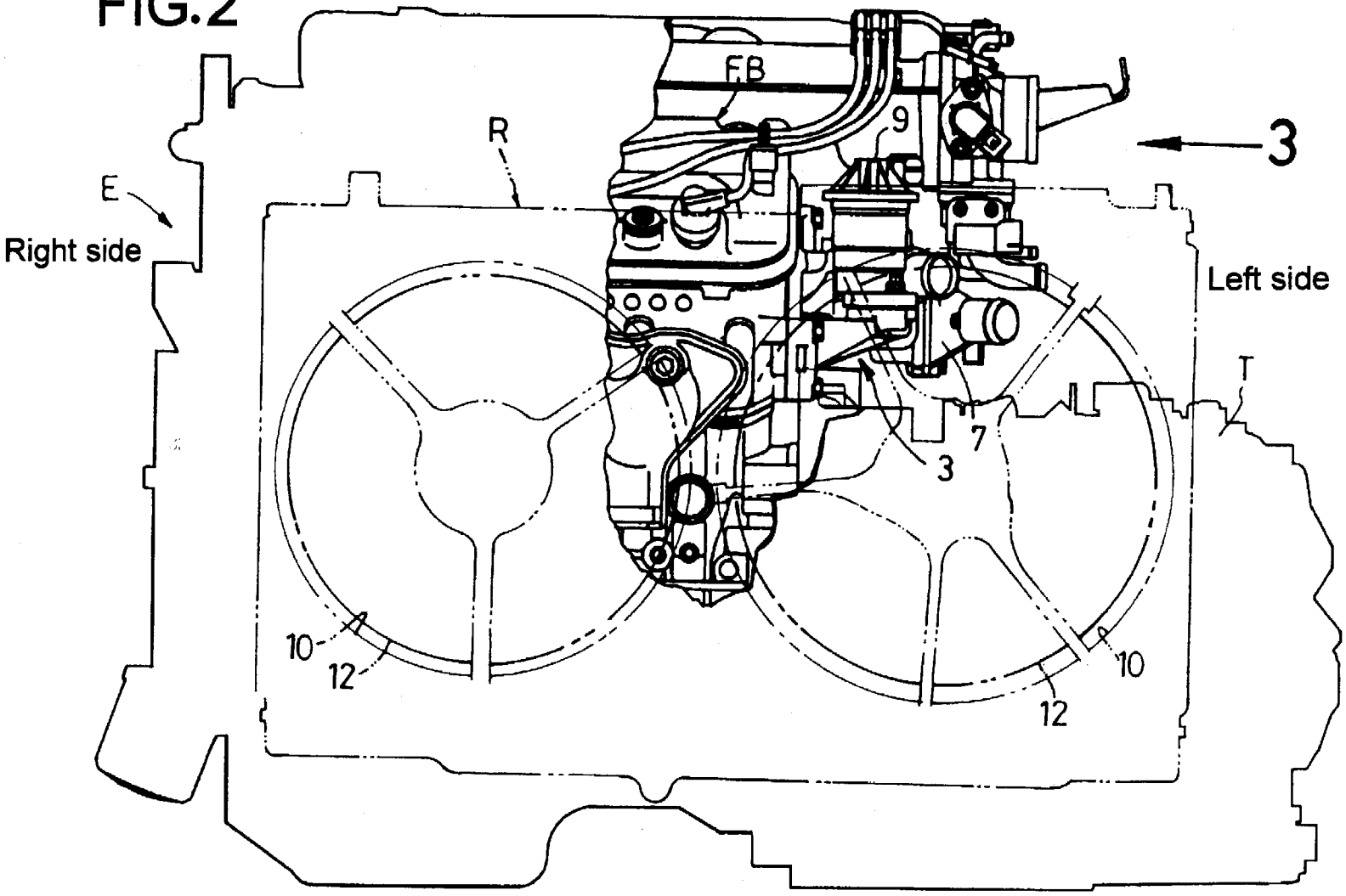
FIG. 2 is a front view of a horizontal V-type engine.

As shown in FIG. 2, the second water passage 3 disposed in the left side of the engine E is disposed within a rearward projection area of the left fan opening 10 in the radiator R and moreover, the EGR valve 9 is carried in a front portion of the second water passage 3 nearest the radiator R. Thus, cooling air can be passed through the fan opening 10 and applied toward the EGR valve supporting area of the from portion of the second water passage 3, thereby promoting the cooling of the EGR valve 9 supported in the second water passage 3. In addition, the second water passage 3 is disposed to utilize a waste space above the transmission T coupled to the left side of the engine E and hence, a space within a narrow engine room can be effectively utilized.

The structure of the second water passage 3 and the supporting of the EGR valve 9 in the second water passage 3 will be described below with reference to FIGS. 3 to 7.

Figure 3:
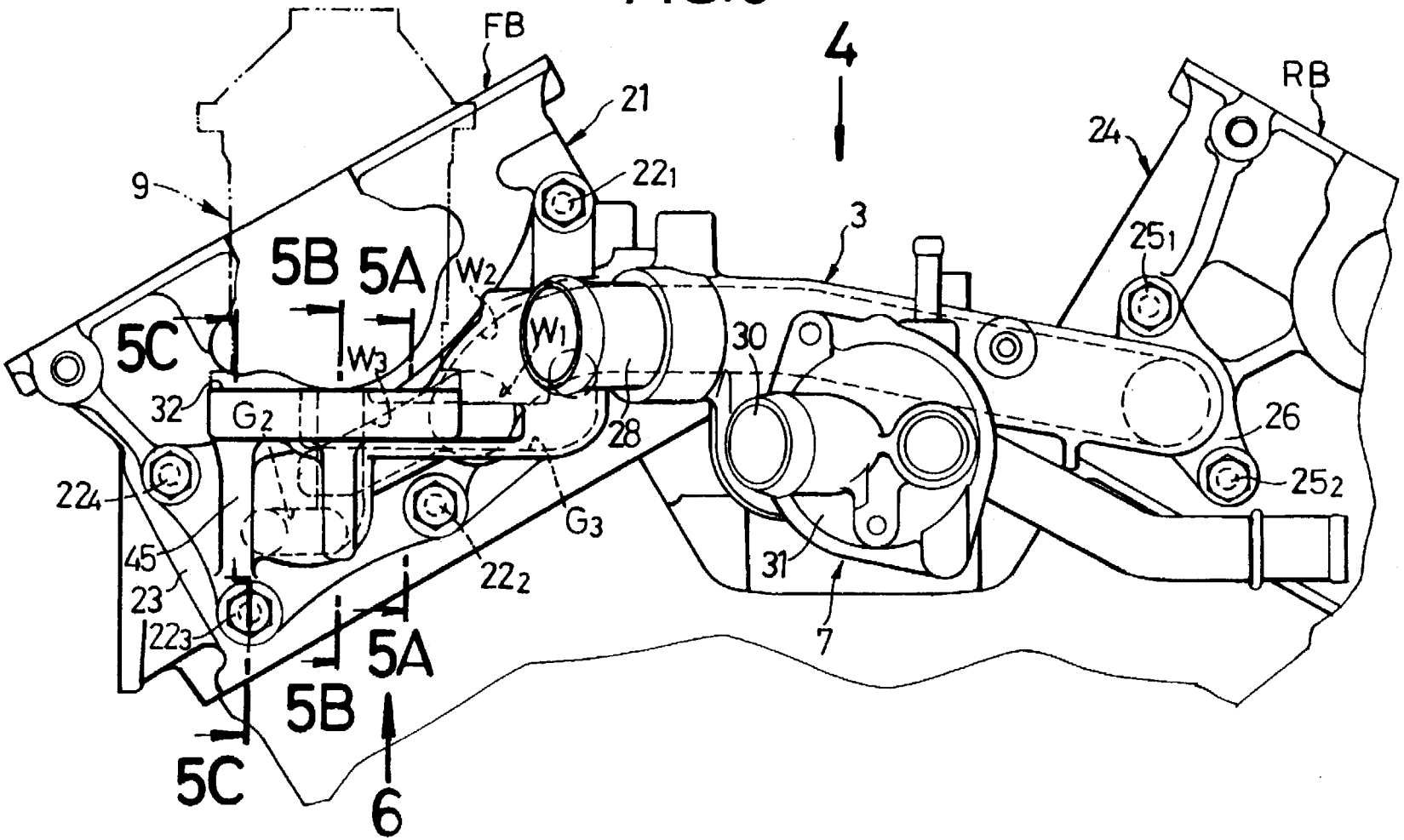
FIG. 3 is an enlarged view taken in a direction of the arrow 3 in FIG. 2.
Figure 4:
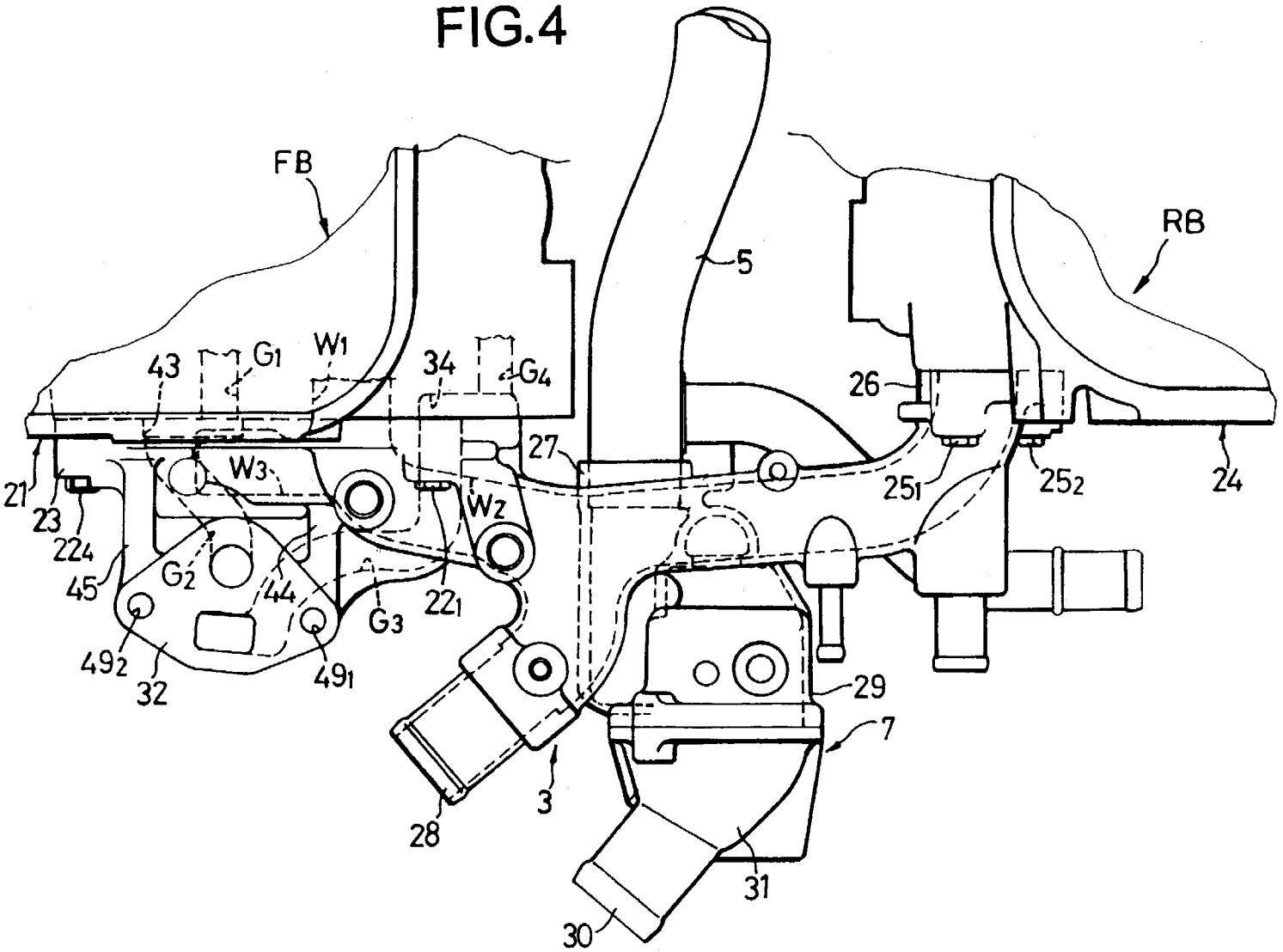
FIG. 4 is an enlarged view taken in a direction of the arrow 4 in FIG. 3.
Figure 5A:
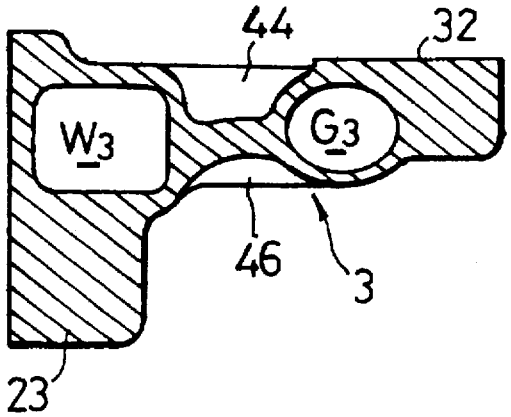
FIGS. 5A, 5B and 5C are sectional views taken along the lines 5A—5A, 5B—5B and 5C—5C, respectively.
Figure 5B:
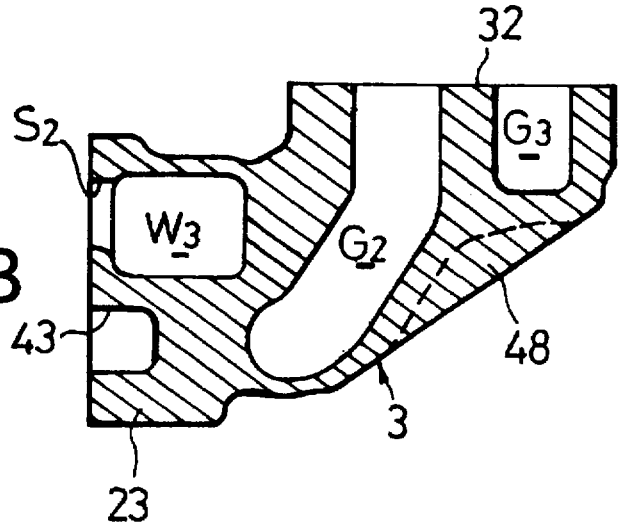
Figure 5C:
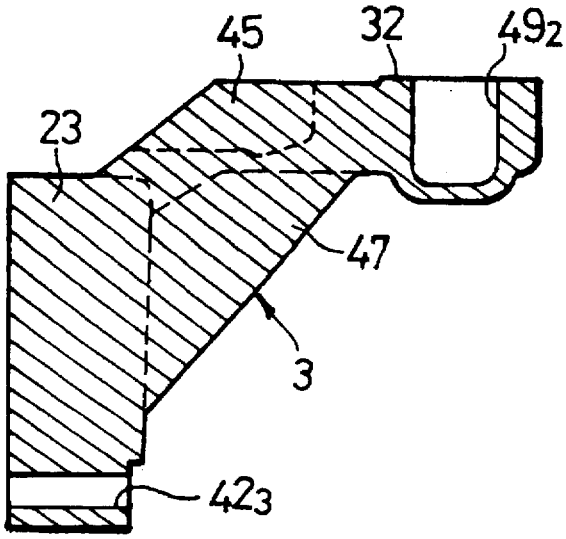
Figure 6:
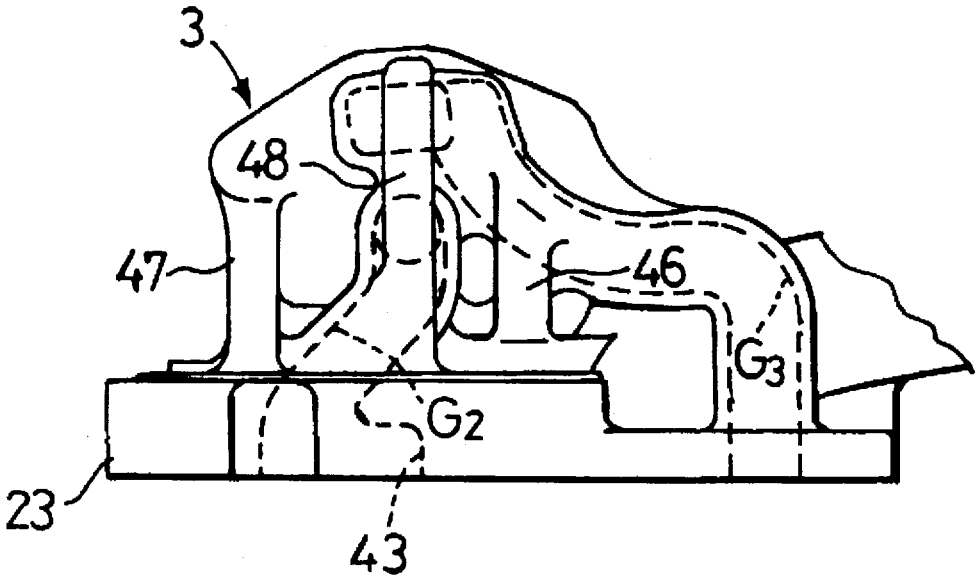
FIG. 6 is a view taken in a direction of the arrow 6 in FIG. 3.

As shown in FIGS. 3 and 4, the second water passage 3 is formed from a single member, and has a front mounting flange 23 provided at its front portion and coupled to the left side of the cylinder head 21 in the front bank FB by four bolts $22_1$, $22_2$, $22_3$ and $22_4$, and a rear mounting flange 26 provided at its rear portion and coupled to the left side of the cylinder head 24 in the rear bank RB by two bolts $25_1$ and $25_2$.

The second water passage 3 is integrally formed at its intermediate portion with: a coupling portion 27 connected to the second cooling-water pipe 5; a coupling portion 28 connected to the third cooling-water pipe 6; and a first case half 29 constituting a portion of a case of the thermo-valve 7. A second case half 31 having a coupling portion 30 connected to the first cooling-water pipe 4 is coupled to the first case half 29 of the thermo-valve 7. An upward turned valve mounting seat 32 is integrally formed at a front portion of the second water passage 3, and a lower surface of the EGR valve 9 is coupled to the valve mounting seat 32.

Figure 7A:
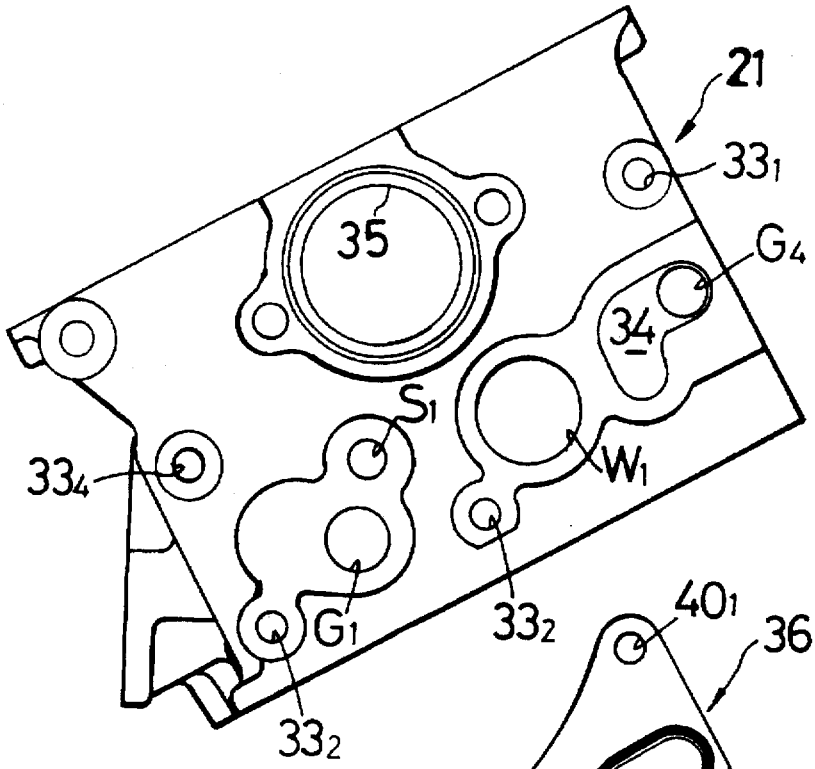
FIGS. 7A, 7B and 7C are views showing a left end face of a cylinder head in a front bank, a gasket and a mounting flange of a water passage.

FIG. 7A shows a left end face of the cylinder head 21 in the front bank FB. Formed in the left end face of the cylinder head 21 are: a first water passageway $W_1$ connected to the water jacket 1 provided in the cylinder head 21; a first gas passageway $G_1$ connected to an exhaust passage (not shown) in the cylinder head 21; a fourth gas passageway $G_4$ connected to an intake passage (not shown) in the cylinder head 21; a sand-removing bore $S_1$ for removing sand of a core during the casting of the cylinder head; a journal 32 for supporting a cam shaft; and bolt bores $33_1$, $33_2$, $33_3$ and $33_4$ into which the four bolts $22_1$, $22_2$, $22_3$ and $22_4$ (see FIG. 3) are passed for fixing the front mounting flange 23 of the second water passage 3. An L-shaped recess 34 is defined in an opening of the fourth gas passageway $G_4$.

Figure 7B:
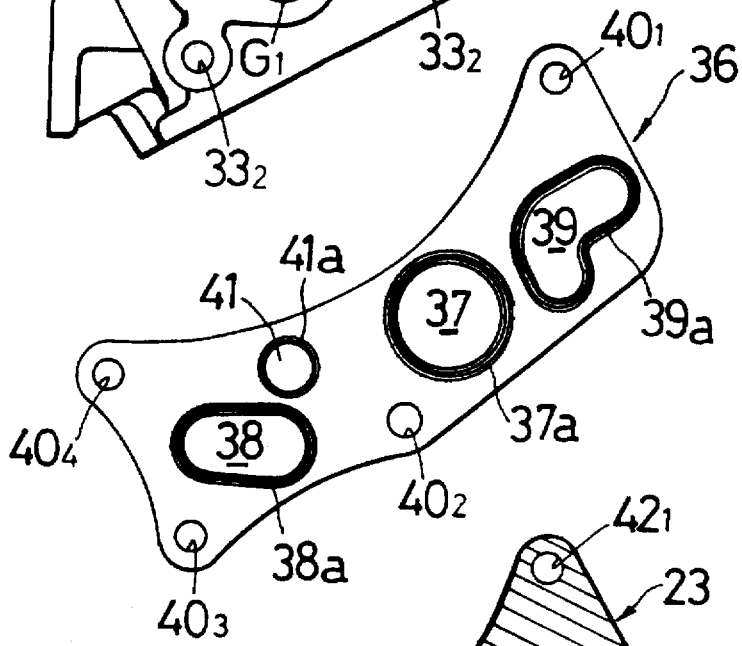

FIG. 7B shows a gasket 36 clamped between the left end face of the cylinder head 21 and the front mounting flange 23 of the second water passage 3. Formed in the gasket 36 are: an opening 37 superposed on the first water passageway $W_1$; an oval opening 38 superposed on the recess 34 in the fourth gas passageway $G_4$; and bolt bores $40_1$, $40_2$, $40_3$ and $40_4$ through which the four bolts $22_1$, $22_2$, $22_3$ and $22_4$ are passed. Beads 37*a*, 38*a* and 39*a* are formed around outer peripheries of the openings 37, 38 and 39. Reference numeral 41 designates a closing wall for closing the sand removing bore $S_1$, and a bead 41*a* is formed around an outer periphery of the closing wall 41.

Figure 7C:
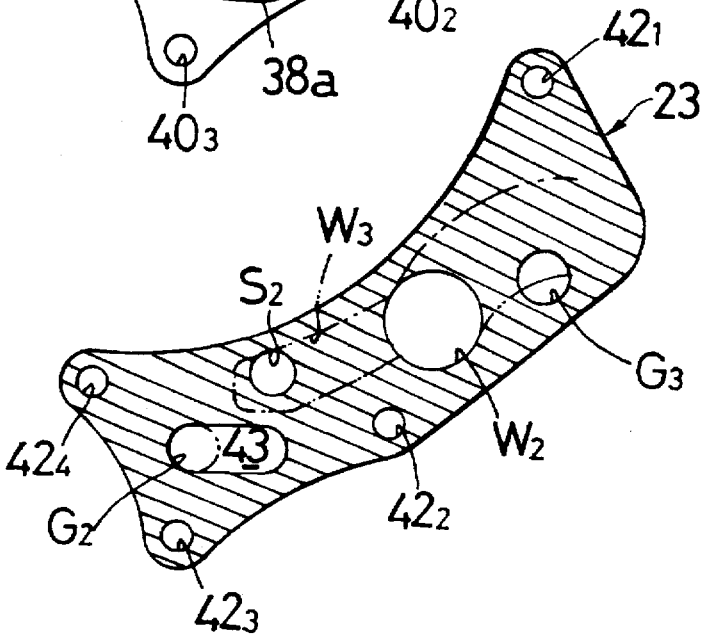

FIG. 7C shows a section of the front mounting flange 23 of the second water passage 3 which is coupled to the left end face of the cylinder 21 through the gasket 36. Formed in this section are: a second water passageway $W_2$ connected to the first water passageway $W_1$ through the opening 37 in the gasket 36; a second gas passageway $G_2$ connected to the first gas passageway $G_1$ through the opening 38 in the gasket 26; a third gas passageway $G_3$ connected to the fourth gas passage $G_4$ through the opening 39 in the gasket 36; a sand removing bore $S_2$ (see FIG. 5B) for removing sand of a core during the casting of the second water passage 3*a*; and bolt bores $42_1$, $42_2$, $42_3$ and $42_4$ through which the four bolts $22_1$, $22_2$, $22_3$ and $22_4$ are passed.

A recess 43 having the same shape as the oval opening 38 in the gasket 36 is formed in an opening in the second gas passageway $G_2$. A blind alley (or cul-de-sac) third water passageway $W_3$ diverges from the second water passageway $W_2$, and the sand removing bore $S_2$ opens into near a dead end of the third water passageway $W_3$. The position of the sand removing bore $S_2$ superposes the closing wall 41 and hence, when the gasket 36 is clamped between the cylinder head 21 and the front mounting flange 23 of the second water passage 3, the sand removing bore $S_1$ in the cylinder head 21 and the sand removing bore $S_2$ in the second water passage 3 are simultaneously closed.

In this way, the common gasket 36 is commonly used for sealing of the water passageways $W_1$ and $W_2$, for sealing of the gas passageways $G_1$, $G_2$, $G_3$ and $G_4$ and for sealing of the sand removing bores $S_1$ and $S_2$. Therefore, it is possible to reduce the number of parts.

As can be seen from FIG. 4, if the front mounting flange 23 of the second water passage 3 is coupled to the cylinder head 21 with the gasket 36 clamped therebetween, the first water passageway $W_1$ in the cylinder head 21 is put into communication with the second water passageway $W_2$ in the second water passage 3. In addition, the first and fourth gas passageways $G_1$ and $G_4$ in the cylinder head 21 are put into communication with the second and third gas passageways $G_2$ and $G_3$ in the second water passage 3, respectively. Therefore, EGR gas removed from the exhaust passage is supplied via the first and second gas passageways $G_1$ and $G_2$ to the EGR valve 9 and therefrom via the third and fourth gas passageways $G_3$ and $G_4$ to the exhaust passage.

As described above, the valve mounting seat 32 for the EGR valve 9 is formed in the second water passage 3 having the second and third water passageways $W_2$ and $W_3$ and further, the second and third gas passageways $G_2$ and $G_3$ connected to the EGR valve 9 are defined in the second water passage 3. Therefore, the valve mounting seat 32 and the EGR valve 9 which are heated by the passing of the high-temperature EGR gas can effectively be cooled with the cooling water flowing through the second and third water passageways $W_2$ and $W_3$ without provision of special cooling means. Moreover, since the second water passage 3 is formed of material different from the material for the intake manifold M, there is very little thermal influence of the high-temperature EGR gas on the intake manifold M which would reduce the intake efficiency.

Additionally, the blind alley-like third water passageway $W_3$ diverges from the second water passageway $W_2$ through which the cooling water flows, and the third water passageway $W_3$ is extended near the valve mounting seat 32. Therefore, the cooling effect can be further enhanced. Further, the first gas passage $G_1$ in the cylinder head 21 and the second gas passage $G_2$ in the second water passage 3 are interconnected in a crank-shaped manner through the recess 43 defined in the second water passage 3, and the third gas passageway $G_3$ in the second water passage 3 and the fourth gas passageway $G_4$ in the cylinder head 21 are interconnected in a crank configuration through the recess 34 defined in the cylinder head 21. Therefore, the flow speed of the EGR gas can be reduced at the crank-shaped portion, so that the sufficient heat exchange of the EGR gas with the cooling water can be performed, thereby further enhancing the cooling effect.

As can be seen from FIGS. 3 to 6, the valve mounting seat 32 for the EGR valve 9 is reinforced by overlying first and second reinforcing ribs 44 and 45 and underlying third, fourth and fifth reinforcing ribs 46, 47 and 48.

The first and second reinforcing ribs 44 and 45 interconnect the front mounting flange 23 and portions of the valve mounting seat 32 in the vicinity of two bolts $49_1$ and $49_2$ (see FIG. 4) for fixing the EGR valve 9 to the valve mounting seat 32. The third and fourth reinforcing ribs 46 and 47 interconnect the front mounting flange 23 and portions of the valve mounting seat 32 in the vicinity of two bolts $49_1$ and $49_2$ below the first and second reinforcing ribs 44 and 45 (see FIGS. 5A and 5C). The fifth reinforcing rib 48 disposed between the third and fourth reinforcing ribs 46 and 47 reinforces a lower surface of the valve mounting seat 32 between the second and third gas passageways $G_2$ and $G_3$ (see FIG. 5B).

By reinforcing the valve mounting seat 32 for the EGR valve 9 by the reinforcing ribs 44 to 48 in the above manner, not only the supporting rigidity for the EGR valve 9 is enhanced, but also a heat releasing area of the second water passage 3 is increased. Therefore, the effect of cooling the EGR valve 9 by the cooling air can be enhanced in cooperation with the cooling by the cooling water.

Although the embodiment of the present invention has been described in detail, it will be understood that the present invention is not limited to the above-described embodiment, and various modifications may be made without departing from the subject matter and scope of the invention defined in claims:

For example, the EGR valve 9 has been supported in the second water passage 3 in the embodiment, but the EGR valve 9 may be supported in the first water passage 2.

What is claimed is:

1. A structure for supporting an EGR valve in an engine, comprising a water passage provided separately from an intake manifold and connected to a water jacket provided in a cylinder head of the engine, said water passage being integrally formed with a valve mounting seat for supporting said EGR valve and a gas passageway connected to said EGR valve.

2. A structure for supporting an EGR valve in an engine according to claim 1, wherein said water passage is formed with a water passageway and disposed in close proximity to said valve mounting seat.

3. A structure for supporting an EGR valve in an engine according to claim 1, wherein said water passage is formed with a gas passageway extending from said cylinder head to said EGR valve, and another gas passageway extending from said EGR valve to the cylinder head.

4. A structure for supporting an EGR valve in an engine according to claim 1, wherein said gas passageway extends from said cylinder head to said EGR valve and includes a crank-shaped passageway portion.

5. A structure for supporting an EGR valve in an engine according to claim 1, further including a water passageway and a gas passageway which are formed in a gasket mounted between said cylinder head and said water passage.

6. A structure for supporting an EGR valve in an engine according to claim 1, wherein said water passage is formed on its upper and lower surfaces with reinforcing ribs.

7. A structure for supporting an EGR valve in an engine according to claim 1, wherein said water passage is disposed with a projection area of a fan opening in a radiator mounted in the engine.

8. A structure for supporting an EGR valve in an engine according to claim 1, wherein said water passage is formed on its upper and lower surfaces with reinforcing ribs.

9. A structure for supporting an EGR valve in an engine according to claim 1, wherein said water passage is formed with a reinforcing rib for interconnecting an EGR valve fastening portion and a mounting flange to said cylinder head.

10. A structure for supporting an EGR valve in an engine according to claim 9, wherein said crank-shaped passageway portion is formed in a mating surface between said cylinder head and said water passage.

11. A structure for supporting an EGR valve in a horizontal V-type engine having a front bank and a rear bank, said structure comprising:

a water passage provided separately from an intake manifold to interconnect water jackets provided in said front and rear banks; and an EGR valve supported near a connection of the water passage to the front bank.

12. A structure for supporting an EGR valve in an engine according to claim 11, wherein said water passage is provided with a valve mounting seat for supporting said EGR valve, and is formed with a water passageway near said valve mounting seat.

13. A structure for supporting an EGR valve in an engine according to claim 11, wherein said water passage is formed with a gas passageway extending from said cylinder head to said EGR valve, and another gas passageway extending from said EGR valve to said cylinder head.

14. A structure for supporting an EGR valve in an engine according to claim 11, further including a water passageway and a gas passageway which are formed in a gasket mounted between said cylinder head and said water passage.

15. A structure for supporting an EGR valve in an engine according to claim 11, wherein said water passage is formed with a reinforcing rib for interconnecting an EGR valve fastening portion and a mounting flange to said cylinder head.

16. A structure for supporting an EGR valve in an engine according to claim 11, wherein said water passage is disposed within a projection area of a fan opening in a radiator mounted in the engine.

17. A structure for supporting an EGR valve in an engine according to claim 11, wherein said gas passageway extends from said cylinder head to said EGR valve and includes a crank-shaped passageway portion.

18. A structure for supporting an EGR valve in an engine according to claim 17, wherein said crank-shaped passageway portion is formed in a mating surface between said cylinder head and said water passage.

* * * * *